United States Patent [19]

Blinn

[11] 3,944,158

[45] Mar. 16, 1976

[54] COLLECTING DEVICE FOR PRODUCING LONG WIRE ROD COILS

[76] Inventor: Franz J. Blinn, Karl Custer-Strasse, 667 St. Ingbert, Saar, Germany

[22] Filed: Feb. 5, 1975

[21] Appl. No.: 547,751

[30] Foreign Application Priority Data

Feb. 23, 1974 Germany ..... 2408850

[52] U.S. Cl. ..... 242/81; 242/84

[51] Int. Cl.[2] ..... B21C 47/00

[58] Field of Search ..... 242/78.1, 79, 81, 83, 84

[56] References Cited

UNITED STATES PATENTS

| | | | |
|---|---|---|---|
| 2,128,278 | 8/1938 | Adams | 242/84 |
| 2,157,811 | 5/1939 | Beach | 242/84 |
| 3,176,385 | 4/1965 | Morgan | 242/83 |
| 3,618,871 | 11/1971 | Gilvar | 242/81 |
| 3,648,736 | 3/1972 | Hill | 242/81 |

*Primary Examiner*—Edward J. McCarthy
*Attorney, Agent, or Firm*—John J. Dennemeyer

[57] ABSTRACT

A collecting device used in co-operation with a vertically displaceable centering mandrel for forming long coils from a given length of wire rod supplied in the form of overlapping non-concentric windings to a collecting space in the device comprises oppositely disposed interceptor arms which can be pivoted into the collecting space to intercept and temporarily store initial ones of the wire rod windings supplied to the space. Additionally oppositely disposed pivotal arms provided with part-conical members are arranged to be rotated into the collecting space in such manner that the part-conical members together form a centering cone for guiding and centring the initial windings and for accommodating the top of the centering mandrel. Means are provided for suddenly rotating all the arms outwardly to permit the collected windings to fall onto a collecting plate and the coil forming process to continue without interruption, the mandrel serving as a guide and centering means, and for rotating the arms back into their position in the collecting space upon completion of the coil to permit the next coil forming process to be started while the mandrel is lowered to permit lateral removal of the completed coil and thereafter returned to its raised position.

6 Claims, 2 Drawing Figures

Fig. 1
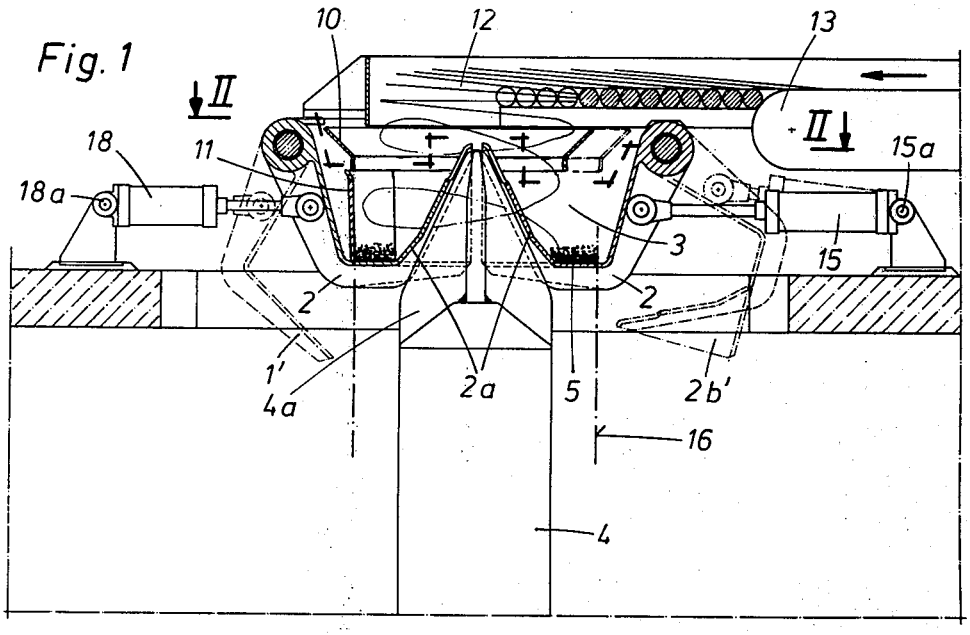
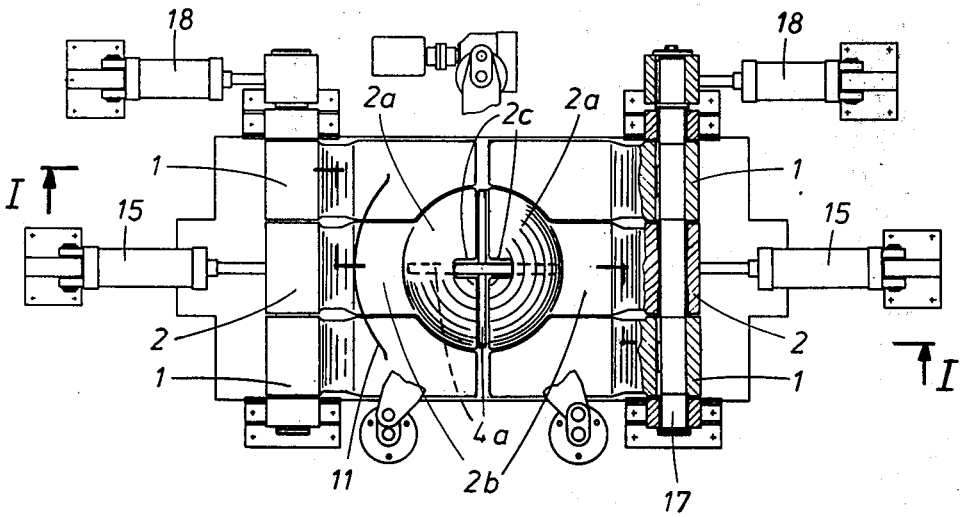
Fig. 2

COLLECTING DEVICE FOR PRODUCING LONG WIRE ROD COILS

This invention relates to a collecting device for producing long wire rod coils from wire supplied in the form of non-concentric overlapping windings continuously fed to the collecting device. Such a device may have a centering mandrel which can be lowered relatively to the collecting space, and controllable interceptor arms which are associated with an upper tapering region of the mandrel and which temporarily intercept the initial downwardly moving wire rod windings produced from a length of wire rod to be collected and release them from free fall on to a collecting plate by a sudden pivotal downward movement.

In a known collecting device for wire rod coils with intermediate storage the apex of the centering mandrel is formed by a loose second centering mandrel which is alternately supportable on the interceptor arms and on the vertically displaceable first mentioned centering mandrel for the purpose of collecting the initial windings of a long wire rod coil, thereby to form a partial coil, and thereafter permitting the latter to drop onto a collecting plate disposed further below.

This two-part mandrel construction necessitates guidance of the loose mandrel on the lower vertically displaceable main mandrel but this guidance does not exist just at that instant when, after completion of a coil, the upper mandrel is received again by the interceptor arms in order to intercept the initial wire rod windings of the next following length of wire rod, because then the main mandrel must be lowered to a low position which permits lateral conveyance of the coil. If the wire rods to be coiled follow each other in short succession, the intermediate storage of the respective initial wire rod windings occurs with the loose upper centering mandrel unguided. The latter cannot therefore correctly fulfil its task as centering means for the downwardly moving wire rod windings, becuase it itself is not safely centered on the interceptor arms.

The invention is based on the object of finding a different solution for the collection and intermediate storage of downwardly moving wire rod windings, wherein a mandrel point which can be temporarily inserted in a highest position is independent of guidance by and support on a main mandrel. As a solution of this problem the invention provides a collecting device for producing long wire rod coils from overlapping non-concentric wire rod windings which are continuously supplied to the collecting device, the device co-operating with a centering mandrel which is vertically displaceable relatively to a collecting space in the device, and having controllable interceptor arms which are functionally associated with an upper tapering region of the mandrel, which temporarily intercept the initial downwardly falling wire rod windings produced from a desired length of wire rod to be coiled and which, by a sudden downward movement, release the temporarily collected wire windings for free fall onto a collecting plate, wherein oppositely disposed pivotal arms are provided in addition to the interceptor arms and arranged to be pivoted into the collecting space to form a mandrel point by means of their free oppositely disposed ends each of which forms a major portion of half a cone surface, and wherein furthermore control means are provided for the interceptor arms as well as further pivotal arms forming the part-conical surfaces, and are operable in such a manner that shortly prior to the pivotal downward movement of the interceptor arms the pivotal arms are rotated downwardly to such extent that the part-conical surfaces thereof are located outside the vertical projection of the outer limits of the temporarily intercepted wire rod windings.

A collecting device constructed in accordance with the invention ensures that during the intermediate storage of the initial wire rod windings a cone surface is always available in a position which is accurately defined independent of the vertical level at which the vertically displaceable centering mandrel is located.

Advantageously a flat surface at the foot of each part-conical surface is flush with the level of the inwardly pivoted interceptor arms in order that the periphery of the lower wire rod windings is supported as much as possible during the intermediate storage.

Undesirable displacement of the wire rod windings is avoided by contactless outward pivotal movement of the oppositely disposed pivotal arms away from the previously collected windings forming a partial coil.

Preferably always two interceptor arms and one pivotal arm disposed therebetween are mounted on a common pivot shaft, whereby a considerable constructional simplification is obtained.

One constructional example of the invention is described below with reference to the accompanying drawing, in which:

FIG. 1 is a side view of wire rod coil forming apparatus including the collecting device according to the invention, the device being illustrated in vertical section on the line I—I in FIG. 2; and FIG. 2 is a plan view of the collecting device, partly in section on the line II—II in FIG. 1.

FIG. 1 illustrates apparatus for producing a long wire rod coil (not shown) that is to say a wire rod coil which has an axial length which is a larger fraction of, equal to, or greater than the diameter of the coil. In this apparatus the coils are formed from wire rod windings 12 which are non-concentrically disposed in a mutually overlapping manner on a conveyor 13 continuously feeding the windings 12 into a funnel 10. The windings 12 are produced from a wire rod having a desired predetermined length. The funnel 10 is afforded an oscillating and rotating movement whereby the windings are caused to fall into the collecting device still to be described in a manner ensuring formation of a coil of uniform thickness. The apparatus further includes a vertically displaceable mandrel 4 which, in its uppermost position extends centrally through the collecting device. The top of the mandrel 4 is provided with four ledges **4*a* which are disposed at right angles to each other, as shown more clearly in FIG. 2, and which taper upwardly to form a pointed upper end of the mandrel 4.**

The collecting device comprises an abutment wall 11 which defines the peripherally outer limits of a collecting space 3. Furthermore two mutually parallel horizontal pivot shafts 17 are located outside the abutment wall 11 on opposite sides thereof. Each shaft 17 has mounted thereon two interceptor arms 1 and between them one pivotal arm 2, the arms of this one shaft being located diametrally opposite the respective arms of the other shaft.

Each interceptor arm 1 is substantially L-shaped in cross-section, and the free end of one limb of each arm in rigidly connected to the respective pivot shaft 17. The other limb of each arm 1 has a flat surface on the side thereof facing the respective first mentioned limb.

Each of two hydraulic cylinder-piston devices 18 has one end 18*a* pivotally supported at a fixed location and is arranged to rotate the respective pivot shaft 17 together with the interceptor arms 1 mounted thereon into a first position shown in full lines, in which the said other limbs of the interceptor arms 1 extend into the collecting space 3, and a second position 1' shown in broken lines, in which the said arms are located outside the downwardly extended limits 16 of the abutment wall 11.

The pivotal arms 2 are generally U-shaped in cross-section. One limb of each arm is substantially straight, and its free end is mounted on the respective pivot shaft 17 in a freely rotatable manner. The web member 2*b* of each arm 2 has a flat surface facing inwardly of the U-shape. The other limb 2*a* is part-conical, its part-conical surface facing the straight limb and tapering to a point at the free end of the limb. Each of two hydraulic cylinder-piston devices 15 has one end 15*a* pivotally mounted at a fixed location and its other end connected to the respective pivotal arms 2, and each is arranged to rotate the respective arm 2 into a first position shown in full lines, in which the part-conical limb 2*a* is located inside the collecting space and the part-conical surfaces of the two oppositely disposed pivotal arms 2 together form a major part of a cone surface in the centre of the collecting space 3, and into a second position 2*b'* shown in broken lines in which the part-conical limb 2*a* of each arm 2 lies outside the downwardly extended limits 16 of the abutment wall 11.

When all the arms 1 and 2 are rotated into the said first positions, the flat surfaces on the limbs of arms 1 and on the web members of arms 2 together form a flat support surface for temporarily receiving thereon a partial coil 5 in a manner still to be described.

Also in this position of the arms 1 and 2 the tapered upper end of the mandrel 4 can enter from below into the cone formed by the part-conical limbs of the two pivotal arms 2, and in this position two of the ledges 4*a* are located between the opposing edges of the two part-cones, and the upper ends of the two other ledges 4*a* extend through recesses 2*c* provided in the limbs 2*a* at their free ends.

In order to explain the operation of the device, it is assumed that the mandrel 4, the interceptor arms 1 and the pivotal arms 2 are in the position shown in full lines in FIG. 1.

Wire rod windings 12 continuously supplied by the conveyor 13 fall into the collecting space 3 and are uniformly deposited by the intervening action of the funnel 10 and the abutment wall 11 on the support surface constituted by the respective flat surfaces of the arms 1 and 2 and form thereon the partial coil 5. The composite conical surface serving as an accurately defined guiding and centering means for the windings. Thereafter, first the cylinder-piston devices are actuated to swing the pivotal arms 2 into their positions 2*b'*, and immediately thereafter the cylinder-piston devices 18 are actuated to swing the interceptor arms 1 into their positions 1', whereby the partial coil 5 is permitted to fall onto a collecting plate (not shown) while being guided by the mandrel 4. The swing movement of the pivotal arms 2 is not impeded by the mandrel 4 because of the provision of the recesses 2*c*, and the relative position of the windings in the partial coil 5 is not disturbed owing to the shape of the arms and the location of the pivot axes which are so selected that the pivotal arms can rotate downwardly away from the coil without further engaging it. The coil winding process continues uninterruptedly until the coil is completed, the tapered top and the body of the mandrel 4 serving as guiding and centering means.

Upon completion of the coil, the mandrel 4 is lowered to permit the coil to be released for lateral conveyance. Even during the downward movement of the mandrel 4 all the arms can be rotated back into the starting position, whereupon formation of a next following coil can be initiated. In due course the mandrel is raised again into its position shown in FIG. 1, and the partial coil formed in the meantime can then be released as described above.

What is claimed is:

1. In apparatus for forming a long wire rod coil from wire rod supplied in the form of overlapping non-concentrically disposed wire rod windings and utilizing a vertically displaceable centering mandrel having an upper end tapering to a point, a collecting device comprising wall means laterally defining a collecting space, means for supplying said wire rod windings into said collecting space, mutually oppositely disposed interceptor arm means pivotal into said collecting space for intercepting and temporarily supporting initial ones of said wire rod windings supplied to said collecting space, and mutually oppositely disposed pivotal arm means, each of said pivotal arm means being provided with a part-conical member, said pivotal arm means being pivotal toward said collecting space into a position wherein the part conical members of said pivotal arm means form a centrally disposed composite cone means adapted to accommodate therein said upper end of said centering mandrel and having a composite conical surface for centering said initial wire rod windings and guiding them onto said interceptor arm means, and means for pivoting said pivotal arm means and said interceptor arm means out of said collecting space to permit said initial windings collected on said interceptor arm means to drop along said mandrel toward its lower end and to enable further wire rod windings to be collected about said centering mandrel to complete formation of said coil.

2. A collecting device for producing long wire rod coils from overlapping non-concentric wire rod windings which are continuously supplied to the collecting device, the device co-operating with a centering mandrel which is vertically displaceable relatively to a collecting space in the device, and having controllable interceptor arms which are functionally associated with an upper tapering region of the mandrel, which temporarily intercept the initial downwardly falling wire rod windings produced from a desired length of wire rod to be coiled and which, by a sudden downward movement, release the temporarily collected wire windings for free fall along said mandrel toward its lower end, wherein oppositely disposed pivotal arms are provided in addition to the interceptor arms and arranged to be pivoted into the collecting space, each pivotal arm having at its free end one half of a conical surface, and said arms being pivotable into the collecting space wherein the halves of the conical surface cooperate to form a mandrel point independent of said vertically displaceable centering mandrel, and wherein furthermore control means are provided for the interceptor arms as well as for the pivotal arms forming the part-conical surfaces, and are operable in such a manner that shortly prior to the pivotal downward movement of the interceptor arms the pivotal arms are rotated downwardly to such extent that each half of the conical surface is located outside the vertical projection of the outer limits of the temporarily intercepted wire rod windings.

3. A collecting device according to claim 1, wherein each of the oppositely disposed pivotal arms merges at the foot of the half of the conical surface into a flat support surface which, when the pivotal arm is in the inwardly pivotal position, is flush with the level of the inwardly pivoted interceptor arms.

4. A collecting device according to claim 1, wherein each of the part-conical surfaces of the oppositely disposed pivotal arms is provided at its apex with a recess, the recesses being adapted to receive the two appropriate oppositely disposed ones of four radial ledges forming the point of the centering mandrel when the later is in, or near, its uppermost position and the pivotal arms rotate downwardly.

5. A collecting device according to claim 1, wherein two parallel pivot shafts are provided, each having one of the said pivotal arms mounted thereon as well as two interceptor arms, one on each side of the pivotal arm.

6. A collecting device according to claim 2 wherein two parallel pivot shafts are provided, each having one of the said pivotal arms mounted thereon as well as two interceptor arms, one on each side of the pivotal arm.

* * * * *